US008224480B2

(12) United States Patent
Mok et al.

(10) Patent No.: US 8,224,480 B2
(45) Date of Patent: Jul. 17, 2012

(54) AUTOMATED DISPENSER WITH A PAPER SENSING SYSTEM

(75) Inventors: Kin Lun Mok, Hong Kong (CN); King Lun Mok, Hong Kong (CN); Hong Ng, Hong Kong (CN)

(73) Assignee: SCA Hygiene Products AB, Gothenburg (SE)

( * ) Notice: Subject to any disclaimer, the term of this patent is extended or adjusted under 35 U.S.C. 154(b) by 817 days.

(21) Appl. No.: 12/097,674

(22) PCT Filed: Dec. 14, 2005

(86) PCT No.: PCT/EP2005/013448

§ 371 (c)(1),
(2), (4) Date: Sep. 11, 2008

(87) PCT Pub. No.: WO2007/068269

PCT Pub. Date: Jun. 21, 2007

(65) Prior Publication Data

US 2009/0198373 A1 Aug. 6, 2009

(51) Int. Cl.
*G06F 17/00* (2006.01)

(52) U.S. Cl. ..... 700/231; 221/33; 221/45; 242/554.5

(58) Field of Classification Search ..... 83/649; 221/13, 33, 45; 225/14, 51, 82; 242/554.2, 242/554.5, 563, 564.1, 564.4; 312/34.8; 324/658, 664

See application file for complete search history.

(56) References Cited

U.S. PATENT DOCUMENTS

| | | | | |
|---|---|---|---|---|
| 5,375,785 | A | 12/1994 | Boone et al. | |
| 5,452,832 | A * | 9/1995 | Niada | 225/11 |
| 5,526,973 | A | 6/1996 | Boone et al. | |
| 5,772,291 | A * | 6/1998 | Byrd et al. | 312/34.22 |
| 6,710,606 | B2 * | 3/2004 | Morris | 324/658 |
| 6,736,348 | B1 | 5/2004 | Formon et al. | |
| 6,820,785 | B2 * | 11/2004 | Kapiloff | 225/14 |
| 6,830,210 | B2 | 12/2004 | Formon et al. | |
| 6,871,815 | B2 | 3/2005 | Moody et al. | |
| 6,903,654 | B2 * | 6/2005 | Hansen et al. | 340/562 |
| 6,988,689 | B2 | 1/2006 | Thomas et al. | |
| 7,017,856 | B2 | 3/2006 | Moody et al. | |
| 7,114,677 | B2 | 10/2006 | Formon et al. | |
| 7,182,289 | B2 | 2/2007 | Moody et al. | |
| 7,191,977 | B2 | 3/2007 | Denen et al. | |
| 7,237,744 | B2 | 7/2007 | Morris et al. | |
| 7,296,765 | B2 | 11/2007 | Rodrian | |
| 7,341,170 | B2 | 3/2008 | Boone | |
| 7,387,274 | B2 | 6/2008 | Moody et al. | |
| 2001/0001475 | A1 | 5/2001 | Formon et al. | |

(Continued)

FOREIGN PATENT DOCUMENTS

| | | |
|---|---|---|
| EP | 0 880 331 | 10/2004 |

(Continued)

*Primary Examiner* — Timothy Waggoner
(74) *Attorney, Agent, or Firm* — Young & Thompson

(57) ABSTRACT

A dispenser for dispensing a portion of sheet product stored in a dispenser, in which a dispensed sheet portion is to be removed by tearing the sheet portion from the remaining product supply. The dispenser includes a system which detects the presence of sheet product in a region of a dispensing outlet. Upon detection of a potential user, the sensing system causes dispensing of paper, on the condition that the sheet portion is regarded as having been torn off. The system includes elements for detecting a discontinuity in the sheet product.

16 Claims, 6 Drawing Sheets

U.S. PATENT DOCUMENTS

| | | | | |
|---|---|---|---|---|
| 2002/0117578 | A1* | 8/2002 | Denen et al. | 242/563 |
| 2003/0169046 | A1 | 9/2003 | Morris | |
| 2003/0183717 | A1 | 10/2003 | Chen et al. | |
| 2005/0171634 | A1 | 8/2005 | York et al. | |
| 2006/0006275 | A1 | 1/2006 | Neveu et al. | |
| 2006/0173576 | A1 | 8/2006 | Goerg et al. | |
| 2007/0080255 | A1 | 4/2007 | Witt et al. | |
| 2007/0152010 | A1 | 7/2007 | Denen et al. | |
| 2007/0158359 | A1 | 7/2007 | Rodrian | |
| 2007/0194166 | A1 | 8/2007 | Reinsel et al. | |
| 2008/0011772 | A1 | 1/2008 | Morris et al. | |
| 2008/0018302 | A1 | 1/2008 | Reinsel et al. | |
| 2008/0078777 | A1 | 4/2008 | Cittadino et al. | |
| 2008/0087758 | A1 | 4/2008 | Formon et al. | |
| 2008/0099595 | A1 | 5/2008 | Lewis et al. | |

FOREIGN PATENT DOCUMENTS

| | | |
|---|---|---|
| EP | 1 716 800 | 11/2006 |
| WO | 02/00083 | 1/2002 |
| WO | 2005/065509 | 7/2005 |
| WO | 2006/060047 | 6/2006 |
| WO | 2006/065515 | 6/2006 |
| WO | 2007/098419 | 8/2007 |
| WO | 2008/011460 | 1/2008 |
| WO | 2008/042382 | 4/2008 |
| WO | 2008/042962 | 4/2008 |
| WO | 2008/042964 | 4/2008 |
| WO | 2008/053383 | 5/2008 |

* cited by examiner

FIG. 6
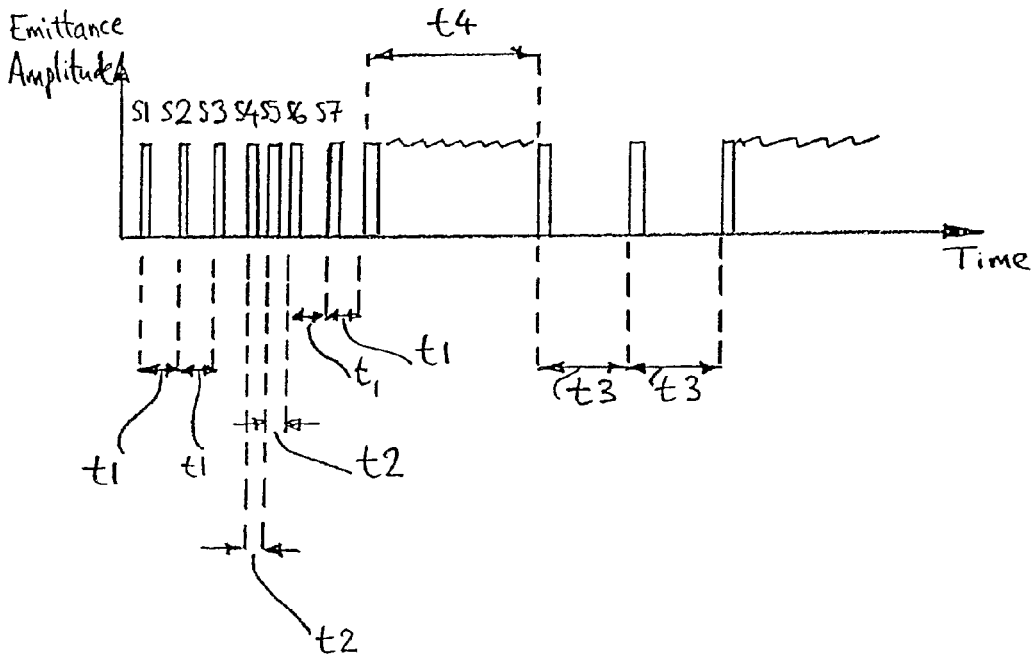
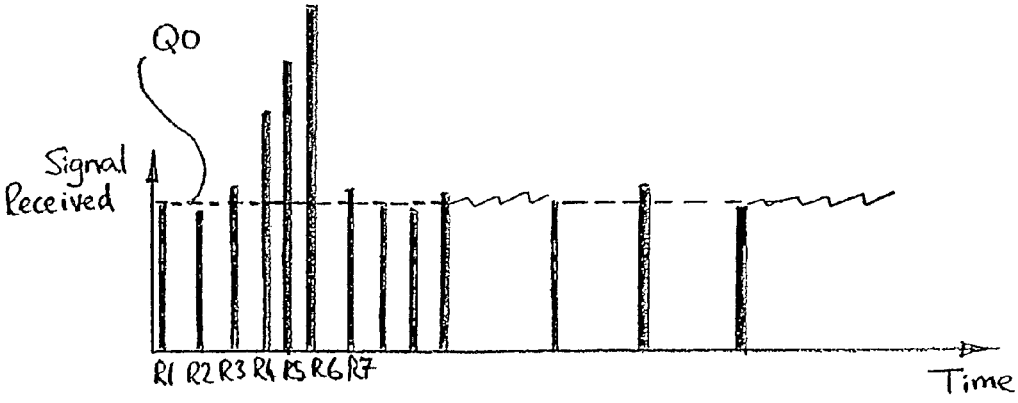
FIG. 7

AUTOMATED DISPENSER WITH A PAPER SENSING SYSTEM

FIELD OF THE INVENTION

The present invention relates to a dispenser including a feeding means driven by a motor for dispensing a portion of sheet product stored in said dispenser, further including a dispensing outlet through which said sheet product is fed upon a feed command being issued by a control means, and a tear means against which one area of said portion is to be drawn so as to allow said sheet portion to be torn and removed from a remaining portion of a sheet product supply, wherein said dispenser includes a sheet sensing means for detecting the presence of sheet in a specific region of said dispenser proximate said dispensing outlet, said sheet sensing means being connected to said control means, wherein said sheet sensing means repeatedly scans said specific region at a first scan interval for the presence of sheet product or a discontinuity of said sheet product.

The invention furthermore relates, in a preferred form, to an automatic towel dispenser (preferably with paper towels stored inside the dispenser housing on a cylindrical supply roll) of the electrically powered type, preferably a battery powered type (but which could also be AC powered or powered by a combination of AC and DC power supplies). Such a dispenser may have an IR sensor system or another sensor system used to control dispensing of products such as paper sheets (e.g. paper hand-towels) when the presence of a possible/potential user is detected, preferably without physical contact of the user with the dispenser (or the sensors) being required for initiating the dispensing sequence.

BACKGROUND TO THE INVENTION

Dispensers of the aforementioned type are known from US2003/0169046 A1.

This document discloses a sheet (paper sheet) sensing means in the form of two sets of sensors (pairs of IR emitters and receivers) in the discharge chute of the dispenser to protect it from ambient infrared (IR), which sensors can detect a leading edge of a paper sheet to be dispensed and then dispense paper as required when a user is present. In a so-called "hanging towel" mode ("sheet hanging" mode), sheet material may be dispensed when absence of material is detected, as this indicates that a towel has been torn off. In both situations, the sensors register the position of a piece of sheet material after the feed mechanism starts to operate so that a leading edge is detected during a first predetermined time period. After detection, a predetermined further amount of material can be dispensed during a second predetermined period. At the end of the feeding cycle which lasts for the predetermined second time interval, a towel length of the required length will have been dispensed for grasping and tearing by a user. When a towel of predetermined length is irregularly torn, one of the sensors may be uncovered while the other one is covered, in which case the control system detects a torn state and allows a new towel to be issued on the next detection of a user.

While the aforementioned dispenser thus provides means for detecting an irregularly torn sheet, it however relies on the fact that a sheet is torn off irregularly at or after the intended time for being torn off, namely after the dispensing operation by the motor has finished. It also relies on the fact that, at that time (after motor feeding has stopped) at least one of the sensors will then still be uncovered.

However it has been recognised that an impatient user may tear off a sheet while it is being fed, so that when the remainder of the predetermined length of sheet (which has not been torn off) continues to be fed out of the discharge chute, the remaining part will cover both sensors. In the aforementioned device this circumstance would of course leave a quantity of sheet still present at the outlet and thus detected by both sensors, causing the system to register that a towel has not been torn off. This can prevent dispensing of a new piece of paper towel until the piece blocking the sensors is removed. Furthermore, as the sensors are in the discharge chute which is designed not to allow access by human fingers, the dispenser may remain inoperable due to the premature tearing that occurred, since no further sensors are located outside the discharge chute to determine that a paper sheet of sufficient length is not present.

SUMMARY OF THE INVENTION

The present invention aims at overcoming the aforementioned problem, such that a prematurely torn sheet will be recognised by the control means.

Further problems which are overcome, will be apparent upon reading this specification.

The features of the independent claim result in a dispenser whereby the sensing means for the sheet product, in particular paper, are caused to scan substantially continuously during the entire operation of the motor which drives the feeding means (e.g. the feed roller), such that whenever a discontinuity in the sheet product is detected (i.e. whenever a lack of sheet product is detected) by the sensing means during motor operation, the sheet sensing means issues a signal to the control means to indicate that sheet material has been torn off. Thus, irrespective of whether the motor continues to run until the end of the time at which a predetermined length of sheet product should be dispensed, or whether the motor stops as soon as (or soon after) a discontinuity is detected, the control means will register that the sheet has been torn off.

In this way, the control means is in a position to be able to issue a sheet feed command (i.e. to issue a command which will activate the drive motor circuitry so as to initiate the dispensing of a further portion of sheet product of a predetermined length) on the next occasion that a user's presence is detected e.g. by a user sensing means, without having to forego the advantage of preventing dispensing when a sheet portion has been fully dispensed but not torn off.

The terminology "tear means" is used herein to mean a means against which an area of said sheet product can be drawn so as to cause said sheet to rupture so that it may be removed. Typically such a tear means may be in the form of a metal plate with a serrated edge. However the edge need not be serrated. Likewise other tear means may be used such as for example a series of plastic sharpened areas or the like or simply a single continuous sharp edge. Further possibilities may also be envisaged and will be clear to a skilled person.

A "scan" as referred to herein is the emittance of e.g. an infrared (IR) signal, and the activation of a detection means to be able to detect the signal e.g. reflected IR. Reflected signals (e.g. reflected IR signals) need not be used however, as an emitter and receiver could be placed opposing each other, whereby the sensor acting as a receiver can be arranged to directly receive the emitted signal (e.g. IR) when no sheet product blocks the path between the emitter and receiver and not to receive the signal from the emitter (or to receive only a relatively low amount of signal from the emitter) when sheet product blocks the path between emitter and receiver. If IR is used as the emitted signal, this may be continuous or pulsed, whereby if pulsing is used the pulsing frequency may be set to cover only a small frequency range (e.g. centered for e.g. up to 3 or 4 kHz on both sides of a central frequency of e.g. 15 kHz) so as to make the IR signal detection more distinguishable from received ambient IR.

During such a scan (i.e. an individual scan comprising emitting a signal of some type which is intended to be received by a receiver for the emitted signal), the (pulsed) IR will be emitted for a brief period of time, normally only a few milliseconds, e.g. one to two milliseconds. When a "scan interval" is mentioned herein, this refers to an interval of time between individual scans, i.e. an. interval between a first emitted signal and a second emitted signal.

A "discontinuity" being detected in the sheet product as mentioned herein, refers to a lack of sheet product being detected during the scan period. The sensing means is thus arranged to detect the presence of sheet product until such time as the product is severed and thus produces a gap, or opening, with respect to the remaining sheet product.

A "specific region" of the dispenser is also mentioned herein. Such a specific region means a region, which in terms of its position is a fixed area with respect to a part of the dispenser, said specific region being a region across which, or past which, the sheet product passes when it is being dispensed by the feeding means from a product supply stored in the dispenser, towards the dispensing outlet. In dispensers using a pair of rollers causing feeding of sheet product through the nip therebetween upon driven rotation of one of the rollers, the specific region will suitably start after the nip between these rollers. Likewise, where a tear edge or tearing means is provided in the dispenser, against which dispensed sheet product may be drawn by a user in order that a dispensed piece of sheet product is removed from the rest of the product supply, the specific region is suitably located slightly after (downstream of) the tear edge or tear means. "Slightly after" hereby means that the start of the specific region very closely follows the tear edge location of the tear means, such as by an amount of typically less than 2 cm, normally less than 1 cm.

Where the term "upstream" or "downstream" is used herein, this refers to a position in the direction of feeding sheet product (i.e. from inside the dispenser housing to outside the dispenser housing via the dispensing outlet).

When the sensing means is operating to perform a scan at a first scan interval during the time in which said motor is causing the feeding means (typically a feed roller) to feed sheet product towards the dispensing outlet, the first scan interval is preferably set to a value which is shorter than the time taken for tearing off a piece of sheet material against the tear means. Values of up to 50 ms are most suited to this task even if longer time intervals could be used. More suitably however, 20 ms or less may be used for most sheet product dispensers which tend to be less than 40 cm in width. Values below 10 ms are even more preferable to account for very fast tear speeds and a 3 ms interval is even more preferred. While a still shorter interval could be used, this would use more power which could be significant if a battery operated dispenser is used.

Any locations on the dispenser or sensors etc., are defined with respect to the dispenser in its normal position of use and not mounted upside down or the like. Thus, the lower part of the dispenser is intended to be at the bottom. Likewise the lateral direction of the dispenser is in a generally horizontal direction.

Where a vertical direction or plane is referred to, this is normally intended to refer to the generally vertical direction. When the dispenser is mounted on a true vertical wall, the vertical direction is thus a true vertical direction. If however, the wall is slightly inclined by a few degrees, a vertical direction referred to with respect to the dispenser will also be an inclined vertical by the same amount and in the same direction as the wall inclination.

In terms of the user sensing means, a preferable type is a touchless type of sensor system (often referred to as a "hands free" or "non-contact" sensor system), such as an 10. IR sensor system, although other touchless types of sensing means such as capacitative types may be used.

BRIEF DESCRIPTION OF THE DRAWINGS

The invention will now be explained in more detail with reference to certain non-limiting embodiments thereof and with the aid of the accompanying drawings, in which:

FIG. 6 shows a plot of emitted signal amplitude against time FIG. 7 shows a plot of received signal level against time, for a series of received IR reflections occurring due to the emitted IR pulses in a user sensing system.

DETAILED DESCRIPTION OF PREFERRED EMBODIMENTS

Figure 1:
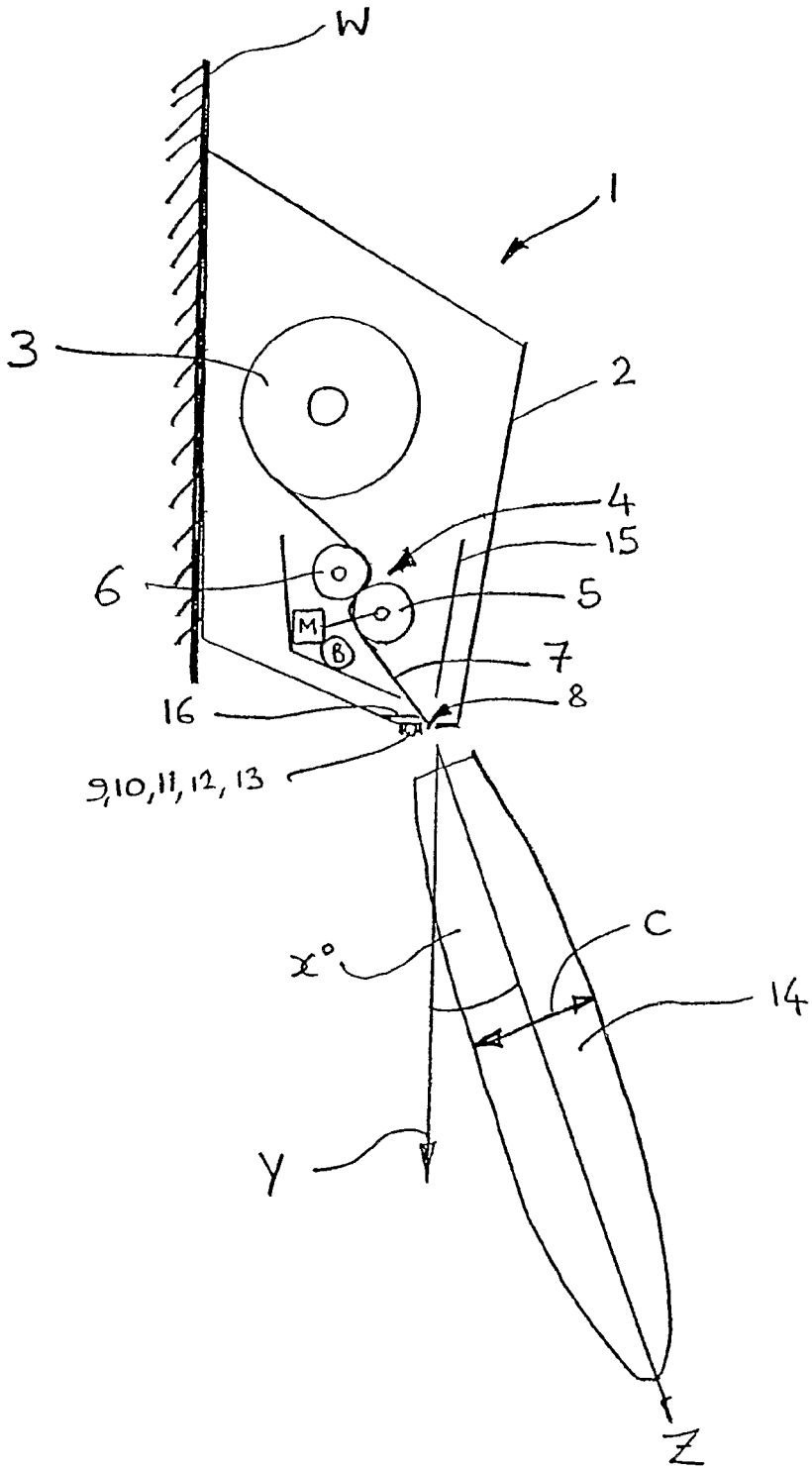
FIG. 1 shows a schematic side view of a sheet material dispenser, depicting a schematic view of a first user sensing system detection zone, whereby a side panel of the dispenser has been removed to show schematic details of the paper roll and paper transport mechanism, whereby also the sheet sensing means has been removed for clarity.

FIG. 1 shows a dispenser 1 in side view, whereby dispenser 1 attached at its rear side to a wall W (the means of attachment are not shown but may be of any suitable type such as screws, adhesive, or other attachment means), whereby the rear surface of the dispenser lies against said wall W which is normally vertical.

The dispenser 1 comprises a housing 2, within which is located a product supply, in this case a supply of paper in a roll 3. The roll 3 is suitably a roll of continuous non-perforated paper, but may also comprise perforated paper. Also located in the housing 2 is a sheet feeding means 4 (e.g. paper transport mechanism) preferably in the form of a modular drive cassette with its own casing 15, which can preferably be removed as a single unit from the housing 2 when the housing 2 is opened.

FIG. 1 schematically shows the paper roll 3 and the sheet feeding means 4 which feeds sheet material 7 from the roll towards a discharge outlet (see further description below) 8 upon rotation of the motor M. The sheet material roll 3 and the sheet feeding means 4 is shown in a vastly simplified form, whereby this includes a drive roller 5 engaged with a counter roller 6, whereby a portion of the sheet product (e.g. paper) 7 is shown located between said rollers 5, 6, with the leading edge of said sheet product 7 ready to be dispensed at a discharge outlet 8 formed in the housing 2 at the lower side thereof.

The drive roller 5 is shown schematically connected to an electrical drive motor M powered by batteries B. A gearing, typically in a gearbox, may be included between the motor drive shaft and. the drive roller 5. Suitable batteries may supply a total of 6V when new. Operation of the motor M causes drive roller 5 to rotate and to thereby pull paper sheet 7 from the paper roll 3 by pinching the paper between the nip of the rollers 5 and 6. Upon actuation, the motor rotates, thereby withdrawing (paper) sheet from the roll 3, which also rotates so as to allow paper to be moved towards the discharge opening 8. Other forms of sheet feeding means for withdrawing paper from a roll and dispensing it may be used. The details of the sheet (paper sheet) feeding means as such are however not important for an understanding of the invention. Such devices are also well known per se in the art.

Figure 2:
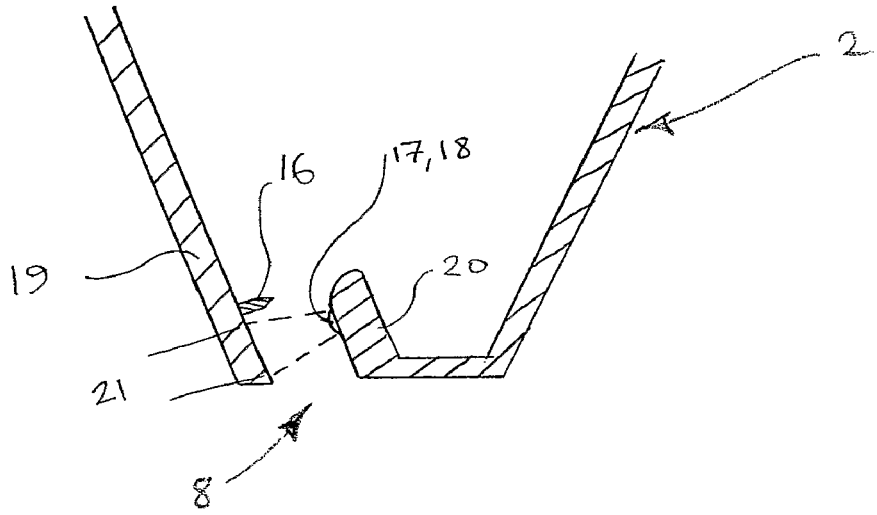
FIG. 2 is a sectional side view of a sheet sensing means proximate the outlet of a dispenser similar to that in FIG. 1 whereby the user sensing system (shown in FIG. 1) is removed, and the sheet sensing means is included.

It will also be understood from the aforegoing that drive roller 5 and counter roller 6 may have their functions swapped such that the counter roller 6 could be the drive roller which is operably connected to the drive motor (and thus the drive roller 5 depicted in FIG. 2 only acts as a counter roller in contact with roller 6, normally with sheet material such as paper or towel material in the nip therebetween).

Although the principle of operation is explained using paper in the form of a continuous paper sheet in a wound roll, it is to be understood that the dispenser may be used to dispense other sheet products from a product supply, such as a continuous piece of paper in concertina format for example. Alternative sheet products may be dispensed by the device. It is also possible that other dispensing devices are tagged on to the dispenser (such as an air freshener activated for example once every e.g. 5 or 10 minutes, or once upon a certain number of towels being dispensed).

The motor M is at rest (not in operation) when no paper is to be dispensed. The motor M is rotated when the feeding means 4 is triggered (by a control means) to dispense paper through the discharge opening 8. The operation of the motor M is controlled by a control means in the form of a master control unit (see FIG. 8) connected to a user sensing system e.g. comprising sensors 9-13, of which two sensors 10 and 12 may be emitters, preferably IR emitters, and three sensors 9, 11, and 13 may be receivers, preferably IR receivers. Such (IR) emitters and receivers are well known in the art and typically comprise diode structures.

The emitters and receivers are shown (FIG. 1) placed on the rearmost side of the discharge outlet 8. Other arrangements of sensors are also possible such as all sensors placed on the front-facing side of the outlet, preferably in a straight row along the discharge outlet. The sensors could alternatively be placed on either side of the discharge outlet (e.g. emitters on one side and receivers on the other side) and likewise extend along the discharge outlet. The discharge outlet could however be placed elsewhere.

The dispenser 1, upon detection of a possible user (e.g. without any contact of the user with the dispenser or the sensors) for a sufficient time in a detection zone thus causes the dispenser to determine that a user is present and, when certain conditions are fulfilled, to dispense sheet material. Dispensing in this case is performed by the front portion of the sheet product 7 being discharged automatically through discharge opening 8 (i.e. a laterally extending opening, generally in the lower part of the housing, and preferably feeding out downwards). This allows the user to grasp the sheet product 7 and to draw it against a tear means 16, such as the sharp cutting edge shown in FIG. 1, proximate the discharge opening 8, so as to tear (and/or cut) and remove a portion 24 of the sheet product 7. The location of the tear means 16 may be varied. It may also be on the opposite side (i.e. side closer to the front of the dispenser) of the discharge outlet 8.

In one example of a touchless-type user sensing system, a user detection zone 14 is shown in FIG. 1 in side view. The user detection zone will however generally be a volume (extending across the lateral direction of the device when viewed from the front) and, in the example shown, is inclined downwardly and forwardly of the discharge opening at an angle x° of preferably between 20° to 30° to the vertical axis Y. To produce such a volume, a set of at least two emitters and three receivers may be used, arranged along the lateral extent of the discharge outlet.

However, the invention described herein is not dependent on the inclusion of any particular user detection system, even though use of the same type of sensing means for user sensing and for sheet material sensing is advantageous since the overall number of circuit parts can be reduced. Advantageously, the user sensing means may include an active IR detection system (i.e. at least one IR emitter and at least one IR receiver) and the sheet sensing means may also include an active IR detection system with at least one IR emitter and at least one IR receiver. When such systems are used respectively for the sheet sensing means and the user sensing means, it is however advantageous if the IR emissions from the (paper) sheet sensing means do not interfere with those from the user sensing means and vice versa. This can be achieved by the relative positioning of the emitters and receivers of the respective means, and/or by providing a different pulsed IR frequency for the respective means (i.e. both during emitting and receiving), where pulsed IR is used in either means.

Figure 3:
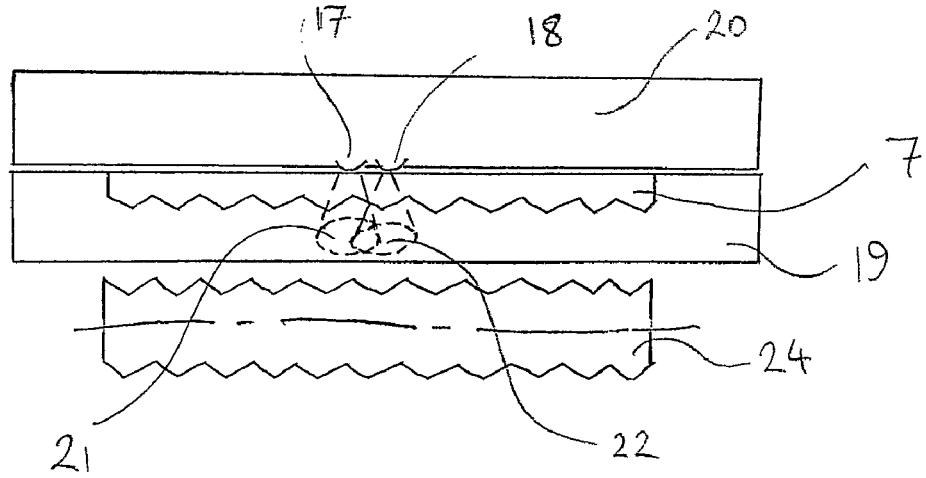
FIG. 3 is a schematic view illustrating the position of sheet material in relation to the sheet sensing means, presenting a discontinuity in the sheet material.

Referring to FIG. 2, the discharge portion 2 of the dispenser 1 is provided with a discharge outlet 8 which is arranged between one wall surface 19 of the housing on which the tearing means 16 is located and a wall portion 20 in which sensors 17, 18 of sheet sensing means are located. These sensors may be partially or completely recessed with respect to the housing portion 20 (or a support unit carried by the housing portion 20), such that IR is directed (here in the form of a trunconic shape) towards a specific region 21 (see FIG. 3) by e.g. sensor 17 which may be an (IR) emitter. Sensor 18 may be an (IR) receiver. The emitted IR signal from emitter 17, in the absence of paper (FIG. 3), is not reflected back towards receiver 18 since the specific region 21, which is e.g. a surface of a housing panel, is arranged not to reflect IR back to receiver 18. This may be done by a specific angle of the surface 19 so as to reflect IR away from receiver 18, and/or by using an IR non-reflecting surface, such as a dark or black surface in the form of e.g. a rectangular or other shaped strip of black or dark material 23 (for use in the case that the sheet material is a light coloured sheet material, e.g. white, greyish white or grey sheet material). Alternatively the area may be coated or painted to provide an IR non-reflecting surface.

When sheet product (e.g. paper) is present over a major part of surface 21, there is however a reflection of IR back to receiver 18. The amount of received IR is converted to a received signal value (e.g. a voltage level) and this value is compared to a threshold value. When the threshold value is exceeded, this informs the control means that paper is present. The threshold value is set appropriately for this purpose, and may be adjusted individually (manually or automatically) to take account of individual types and colour of the sheet product (in particular paper). When no signal or a very low signal is received by receiver 18, the value of the signal will not surpass the threshold value and the control means is thus set to assume that no paper is present in the sheet sensing means detection zone (i.e. sheet product 7 is not in front of the specific region 21).

The sheet sensing means including sensors 17, 18 performs a scan at a scan interval. The scan can be performed at a first scan interval and at least a second scan interval. The first scan interval is significantly shorter than the second scan interval. At the first scan interval, the sheet sensing means will, via suitable control circuitry and software, perform a first scan repeatedly (i.e. a scan is performed repeatedly with a time between each individual scan equal to said first scan interval). During the single scan, a signal is emitted which can be detected by a receiver. In the case of an IR emitter, this emits IR and an IR receiver is activated to receive IR. The signal is emitted for a very short time (e.g. 1 to 2 ms) and this is emitted on a repeating basis at each scanning interval. A first scanning interval may be up to 50 ms, although better results are achieved at intervals less than 20 ms. More preferably the scanning interval is less than or equal to 5 ms and most preferably less than or equal to 3 ms. At a short first scanning interval of around 3 ms, the IR receiver may also be constantly switched on for detecting IR while the IR emitter is switched on and off, although even the IR receiver can be switched on and off if desired in synchronism with the IR emitter.

The first scan interval is used for detecting the presence of sheet product in a virtually continuous manner during driving of the feeding means motor M. In other words, the first scan interval should be short to allow a virtually continuous scanning. The first scan interval should preferably be chosen to be shorter than the time taken, at an estimated maximum tear speed by a user, to tear off a sheet product, and thus a value of 3 ms is most preferable for this scan interval so as to allow any discontinuity in the paper (even when torn fast by a user) to be detected.

The first scan interval is applied to the sheet sensing means by the control means so as to repeatedly scan at said first scan interval. This first scan interval is used when the control means has received a sheet feed command causing start of the motor M driving the feeding means. The first scan interval is maintained between individual scans until the motor M ceases to operate (i.e. from the beginning of the motor operation to the ceasing of motor operation to dispense an amount of sheet material). A second scan interval, considerably longer than said first scan interval, e.g. between 5 and 50 times longer, such as e.g. a second scan interval of 0.17s between scans, will preferably be used once the motor has ceased to operate at the end of said dispensing operation using said first scan interval.

During the scanning operation at the first scan interval or the second scan interval, whenever a discontinuity of paper is detected this will result in a signal being received by the control means which is below a predetermined threshold (as explained above).

Under normal circumstances, a user will wait until the motor M has stopped and will then take hold of the piece of sheet material 7 and tear it against the tear means 16, such that the dispensed material 24 can be removed from the remainder of the material in the dispenser 1. The removal of the dispensed sheet material will then cause the sheet sensing means to detect a discontinuity (situation shown e.g. in FIG. 3).

Figure 4:
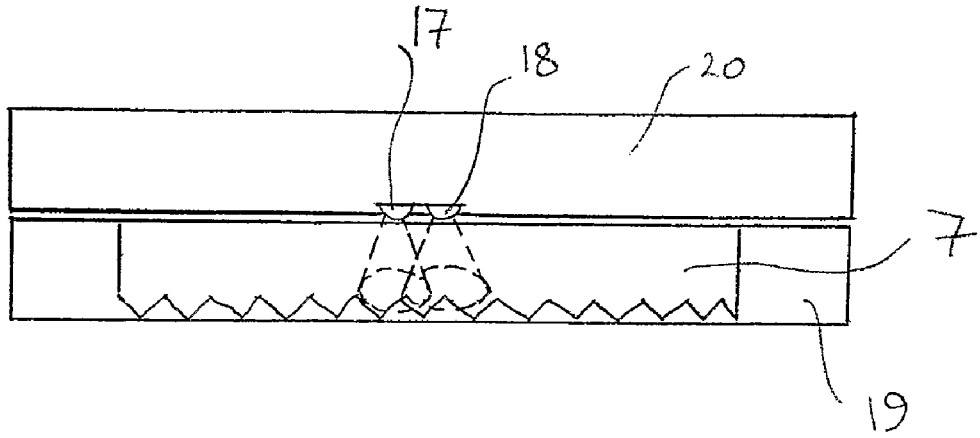
FIG. 4 shows an illustration similar to FIG. 3, wherein sheet material has stopped moving at the end of feeding, in a position where no discontinuity is detected.

However, in accordance with the invention even if the sheet is torn off during dispensing (while the motor M is operating), a discontinuity in the sheet will still be detected because the discontinuity is registered as it passes across the sensors 17, 18, even though the sheet material continues thereafter to be dispensed across the specific region (i.e. to the situation shown in FIG. 4), due to the fact that when the leading (torn) edge of the sheet material passed the sensors, it is detected as a discontinuity, even though upon further dispensing the sheet material again substantially covers the specific region 21 (as also shown in FIG. 4). Thus, by scanning at the (shorter) first scan interval, a signal is sent to the control means indicating that a discontinuity occurred. The short scan interval thus allows temporary discontinuities to be detected.

In these circumstances, a control flag can be set in the control means memory by software, indicating that paper has been torn off, irrespective of the whether the paper is present afterwards in front of the specific region at the end of dispensing action, which would, in the absence of such means, indicate that sheet material is present and would need to be torn off before continuing with a further dispensing cycle.

In this way, even though the specific region 21 may be covered and a strong IR reflection is received from the sheet product 7 (i.e. a received IR value producing a signal value above a set threshold value), the dispenser operates as though there were no sheet product present at the outlet 8 waiting to be torn off. Thus when a further piece of sheet product is to be dispensed (e.g. as controlled by the user's presence being detected by a user sensing system) this will not be prevented by the sensors 17, 18 issuing a signal (due to the second scan interval being used after the motor M has ceased operating to dispense sheet product) that sheet product (i.e. the dispensed portion) is still present waiting to be torn away by a user.

In the arrangement shown in the Figures, the specific region 21 resulting from IR emitted by emitter 17 and a further region 22 from which IR is reflected are not entirely overlapping. These areas could however be made to overlap. A discontinuity can be more easily detected when there is a small area of overlap so that a small specific region is examined, whereby any discontinuity will produce a large change in the amount of IR received.

To improve accuracy, other sheet sensors (not shown), similar to sensors 17 and 18, could be located at other locations around the outlet such as additionally, or alternatively, at the ends of the outlet 8 from where the paper emerges when being dispensed. Nevertheless a location generally at the lateral centre of the discharge outlet 8 is found to be preferred as a sheet discontinuity after tearing is invariably most easily detected at the centre of its width. This may be due to the fact that sometimes the lateral ends of a torn dispensed sheet are not torn off in a way to be detected easily whereas the centre portion is invariably torn.

The dispenser is preferably arranged to deliver a predetermined length of sheet material on each activation of dispensing (i.e. each dispensing cycle). This may be measured by various means such as timing means for starting and stopping the motor M after a predetermined time, or by detecting the amount of motor rotation and stopping the motor when required, etc. The predetermined length can be set in the dispenser control means, preferably adjustably set such as by a variable resistor accessible for example to an attendant who has access to the inside of the dispenser. However, in order that as little sheet product as possible is left hanging from a dispenser when a discontinuity has been detected (which hanging sheets may, in the case of paper towel dispensers, be a matter of hygiene concern), in one embodiment of the invention, the detection of a discontinuity during motor operation may, apart from registering in the control means that a sheet has been torn off (as described above), additionally cause a signal in the control means to be issued to immediately cease operation of the motor M. The motor M would otherwise continue to dispense a predetermined length of sheet product as stated above. Due to the fact that the sheet product is registered as having been torn off however, this will not inconvenience a user, since re-activation of dispensing to issue further sheet material is possible. Also, the stopping of the motor upon a discontinuity being detected has a type of self-teaching function for the user who will then often realise that premature tearing of the (paper) sheet before the predetermined length has been fully dispensed will cause him/her a small delay due to needing to reactivate the dispenser to issue more sheet product.

Also a time control may be built in to the control means to prevent re-activation of the feeding means 4 until a predetermined time has elapsed e.g. a time between 2 and 5 seconds. This helps to prevent unintended use of the dispenser which can otherwise result in all towel material being emptied in a rather short time.

The tear means 16 are placed upstream of the specific region 21 across which the paper passes during dispensing as shown e.g. in FIG. 2. The distance in the feed direction of the sheet material 7 between the tear means 16 and the specific region 21 may suitably be of the order of one to four cm, preferably less than three cm.

As explained above, the control means may include e.g. a memory or a register in which the status from a previous dispensing action can be recorded. The status may be "torn off" or "not torn off" for example. The memory can be simply written in a certain location thereof on each dispensing cycle (i.e. feeding motor start to feeding motor stop) when registering a discontinuity or not. This can be done by setting a flag in the memory or register as soon as a discontinuity appears. In the case that a discontinuity is detected, whether this be during the dispensing cycle or afterwards, the control means will thus have a "torn off" status. Further activation of the dispenser will allow a new piece of sheet product to be dispensed through outlet 8. If no discontinuity is detected either during or after the dispensing cycle (i.e. the time during which the motor operates), the control means will have a "not torn off" status and the control means then controls the motor so that the portion of sheet material that has been dispensed but not torn off must be torn off before further sheet product is dispensed.

The control means maintains a condition (i.e. a control status) not to issue a sheet feed command, even when a user is present and has activated the dispenser (e.g. by being detected by the user sensing system) when the status of "not torn off" is present in the control means. To check whether the sheet portion has been torn off or not after the dispensing cycle is complete (i.e. during a time with ceased operation of the motor) and to save power, one or (if required) more further single sheet sensing scans are performed at a second scan interval which is considerably longer than the first scan interval until such time as the portion 24 is torn off. After a long period of time (e.g. more than 300 seconds) the second scan interval may be increased to a third longer scan interval.

The dispenser may also include a reset means, which after a predetermined time (e.g. 10 minutes) may cause the memory to reset such that the result of a previous scan in which paper is regarded as having been dispensed but still not torn off is erased from memory. In this way, when a user again activates the dispenser by being detected by a user sensing means, further sheet material will be dispensed as if no paper were present at the outlet. This also provides a failsafe setting for the case that an incorrect sensing occurred by the sheet sensing means.

When a user sensing means is present which performs a scanning function to check for the presence of a user (see description further below), the timing of the second scan interval (longer than the first scan interval) for the sheet sensing means can suitably be made to be the same as the scanning interval in the user sensing means used for the time when no user has been detected (i.e. a scan interval t1 as explained below). Alternatively, it may be made a multiple or a fraction of this. For example, where a suitable value of 0.17 seconds is used as a time for scanning for the presence of a possible user in the user sensing means, the second scan interval of the paper sheet sensing means may be set to 0.17 seconds or to twice this time or another multiple thereof. This can be achieved by using both a timing circuit (e.g. an RC circuit as explained with regard to FIG. 9 or FIG. 10) and software programming.

The method by which one or more single scans are performed in an IR sheet sensing means may be the same as that which is explained below in relation to the description of an IR user sensing means performing scans.

When a part of a user's body enters detection zone 14 (see FIG. 1), the user sensing system comprising i.a. sensors 9 to 13 sends a signal to the control means MCU indicating that a user is present, which causes the motor M to turn to dispense a portion of sheet product.

The emitters 10, 12 of the user sensor means mentioned earlier are arranged via the control means which may be part of the control means described above and which may comprise control circuitry as known per se in the art, to emit pulsed IR at a narrow frequency band of for example about 15 kHz±0.5% (to reduce effects of background IR). The receivers 9, 11, 13 (also mentioned earlier), are arranged to detect the emitted IR which is reflected against objects (stationary or moving) back towards the receivers. Such objects may be regarded as background or as a potential user as explained below.

FIG. 6 shows a series of individual scans (i.e. of a pulsed IR emission), of a user sensing means, at a first user scanning rate having a time between individual scans of t1 (i.e. a scan interval of t1), a second user scanning rate having a time between individual scans of t2 (i.e. a scan interval of t2), where t2 is shorter than t1 and a third user scanning rate having a scan interval of t3 where t3 is greater than t1 and t2. The scan interval is measured as the time from the start of one single emitted scan pulse to the time of emitting the next individual scan pulse. Each of the individual scans is here shown, in an exemplary manner, as having the same pulse intensity. A further time t4 is shown which is a predetermined time or a predetermined number of pulses separated by time t1 (i.e. at the first user scanning rate) which needs to elapse before the control means alters the scanning rate to the third, slowest user scanning rate with time interval t3. The pulse width of each pulse is preferably generally constant.

The user scanning interval t1 is set at a constant level to lie between 0.15 to 1.0 seconds, preferably to lie between 0.15 to 0.4 seconds, i.e. such that each individual user scan pulse is separated by an equal time t1. The time t1 can be varied. A suitable rate to optimise the device for battery power saving and reaction time to dispensing has been found to be about t1=0.17 seconds. The second user scanning rate is always faster than the first user scanning rate and t2 is set to lie preferably between 0.05 to 0.2 seconds, preferably between 0.08 and 0.12 seconds between scans. The time t2 can however be varied to be another suitable value, but preferably lies between 30% to 70% of t1. Time t3 may be set at for example between 0.3 and 0.6 seconds, although a longer time t3 is also possible, such as 1 second or even longer. However, for emittance circuit time triggering (in particular by using an RC triggering circuit using the RC time constant to cause a discharge of current to the microprocessor for initiating the timing operation) it is most suitable if t3 is set to double the length of t1. Thus t3 may be set at 0.34 seconds in the case when t1 is 0.17 seconds. The initial time t1 can be made variable, for example via a variable resistor operated from outside the device, although typically this will be factory set so as to avoid unintentional alteration of time t1 which is unsuitable in certain situations.

Time t4 may be e.g. between 30 seconds to 10 minutes and may also be variably set in the device. A suitable value may be about 300 seconds, although may also be more where it is desired to save further power.

Although not shown, it will be apparent that additional time periods may also be set in the device with intermediate time periods (i.e. intermediate between the values of t1 and t2 values, or intermediate between t2 and t3 etc.) or even greater time periods, dependent on operating conditions, although the use of three different user scanning rates has been shown to take account of most situations with good performance in terms of reaction time and power saving.

As can be seen in FIG. 6, after four scans S1-S4 at a time interval of t1, in the embodiment shown, the first user scanning rate changes to the second faster user scanning rate with interval t2 and continues at the second scanning rate for two further scans S5 and S6.

FIG. 7 shows a sample of the possible received signal level (received signal strength) of the received signals R1-R7 caused in response to emitting scan pulses S1-S7.

The approximate background IR level is Q0.

When S1 is emitted and there is no user present, the background level received at R1 will be approximately at level Q0. Likewise at scan S2, the level of IR received is also close to Q0 and thus causes no alteration of the first scanning rate. At scan S3, the received signal level R3 is above background level, but only marginally (e.g. less than a predetermined value, for example less than 10%, above background IR level) and thus the first scanning rate is maintained. Such small changes (below the predetermined level) above and below Q0 can occur due to temporary changes in moisture levels or persons moving at a longer distance from the dispenser, or stray IR due to changes in sunlight conditions or temperature conditions around the dispenser.

At scan S4, the received signal level has reached/surpassed the predetermined value of e.g. 10% above background IR, so the sensor means and its control assumes that a user is present and sheet material is required. In order to be able to react faster when the user is assumed to wish that a piece of sheet material (e.g. a towel) is dispensed, the scanning rate may increase to the second user scanning rate.

Figure 5:
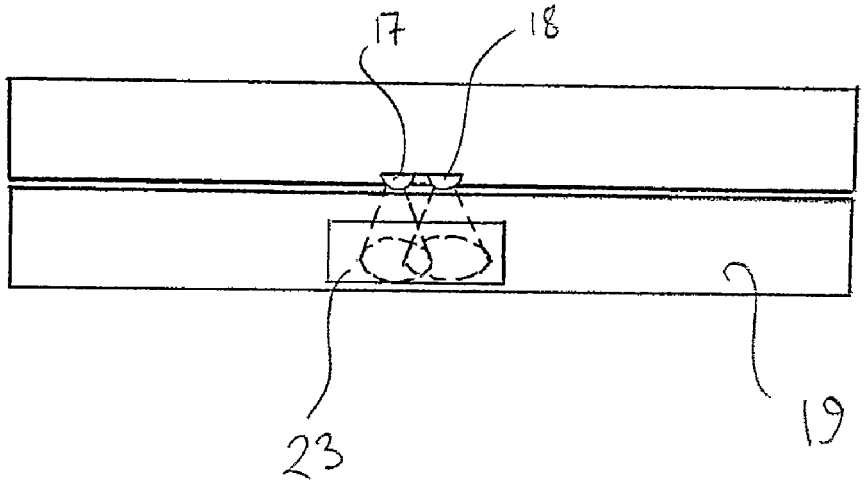
FIG. 5 shows an illustration similar to FIG. 2 but without the presence of sheet product, but with an underlying strip of material on an area of the dispenser covering a specific region proximate the outlet.

If level R5 received on the next scan S5 also fulfils the criteria of being at, or more than, a predetermined level above background IR (e.g. at or greater than 10% above background IR in accordance with the criteria used for the previous scans) the sensor system records via a counter (e.g. in a memory or another form of register) a single detection above the predetermined level and then issues a further scan S6 at interval t2 to check whether the received IR is still at or above the level of 10% greater than background IR Q0. As shown in FIG. 5, this is the case for scan S6, and the sensor system control (comprising both software and a microprocessor in a preferred form) then immediately issues an output to the motor M to start the motor turning in order to dispense a product (e.g. a portion of paper sheet 7 from roll 3). In this case, i.e. when two consecutive scans are above the predetermined level, the system has thus determined that a user is in a zone requiring sheet material to be dispensed. The motor M thus starts to drive the feed means to dispense sheet product 7 through the discharge opening 8 as explained previously, during which the sheet sensing means operates as described previously at the first scan rate.

It is preferable to allow any two of three consecutive user scans to be above the predetermined level, although the number of scans to dispense could be any two out of e.g. four consecutive scans, or even further combinations.

In the case shown in FIG. 6, after a towel or other sheet product 7 has been dispensed, the system alters the second user scanning rate back to the first so as to save power. Scan S7 is thus emitted at time t1 after scan S6. The second user scanning rate can however be maintained for longer if desired.

In the case shown in FIG. 7 (corresponding to the emissions from FIG. 6), where the user has torn off a piece of paper which has been dispensed from the dispenser and thus the level of IR radiation received at R7 is below the predetermined level (e.g. a level of 10% or more above Q0). The predetermined level of 10% can be varied. For example the predetermined level above background level can be up to 90% or more, even up to 95% or more, above background IR. This allows for example a far greater distinction of the reflection from a user's hands compared to any non-desired received IR in the pulsed bandwidth of e.g. 12 to 18 kHz.

After a period of inactivity of time t4, scan rate with a scan interval t3 may be used.

The background level of IR may vary over time. To take account of this in the user sensing means, a moving average of the most recently recorded IR received signals R can be used to alter the level Q0 on a continuous basis. For example, four (or more or less than four) most recently received IR signal values can be used to form the average value of background signal level by dividing e.g. the sum of the four most recent received signal levels by four for instance. As each new value of IR is received, the oldest value of the four values is moved out of the calculation (e.g. by removing it from a register or store of most recent values in the control circuitry) and calculating a new average based on the most recent values.

By using a moving average of background IR level, the further advantage is obtained that when a user who has just withdrawn a towel or other product keeps his/her hands at the dispensing outlet, the received IR level will remain high. However, to prevent a user in this way causing discharge of a large amount of product, e.g. paper towel material, the user's hands will be regarded as being background IR when they are relatively stationary and thus dispensing will not occur. To dispense further sheet material (e.g. paper), the user must therefore move his/her hands away from the dispenser sensors to allow a reading of "true" background IR (i.e. background IR without the user's hands being present too close to the device). Only upon renewed movement of the user's hands towards the user sensing means sensors can a sheet be dispensed again.

It will also be appreciated that as the batteries of the dispenser discharge over time, the power supplied to the sensors may also be affected which may cause less efficient operation. To prevent this occurring and thus to ensure a stable voltage is available for supply to the sensors in the user sensing means and/or in the sheet sensing means, until a time close to total battery depletion, a constant current sink may be employed. Such constant current sinks providing voltage stability are well known in the art of electronics and thus are deemed to require no further description here, although it will be understood that their use in the sensing circuitry for such a dispenser as described herein is particularly advantageous. The amount of extra energy required to operate a constant current sink is negligible and thus use of such a device is barely noticeable on battery useable lifetime.

The power supplied to the emitters of the user sensing means may be varied by automatic control, in particular to achieve optimised levels to take account of background conditions, to provide reliable and fast sensing and to provide dispensing without using unnecessary power.

Figure 8:
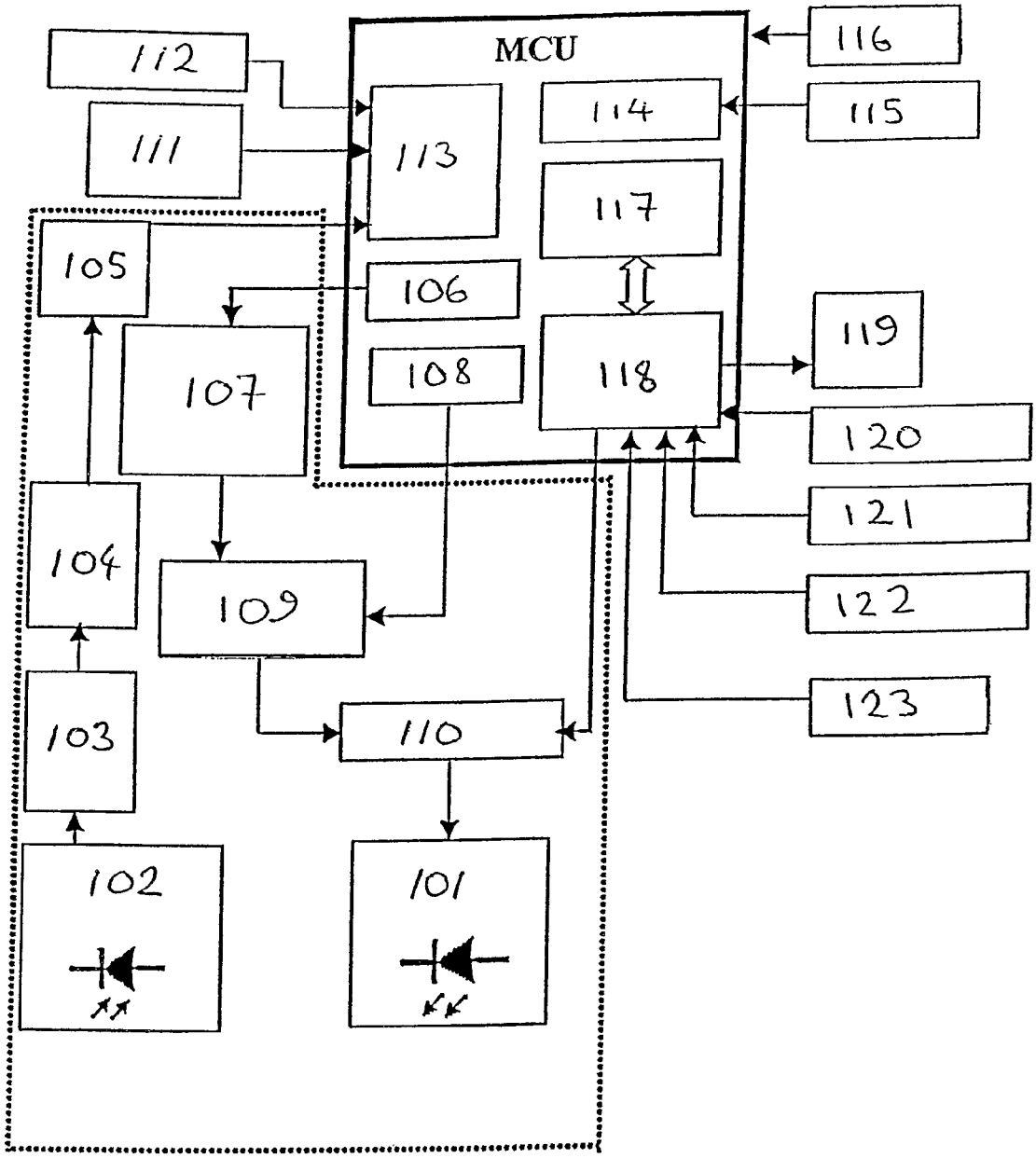
FIG. 8 shows a block diagram of the basic system elements of an embodiment of a dispenser.

FIG. 8 shows a block diagram of the basic system of one embodiment of a dispenser which may be used for the invention, in which the portion shown in dotted lines includes the basic components for IR signal modulation, IR emission and IR reception used to submit a sensing signal to the A/D modulation of the master control unit (MCU) which unit contains a microprocessor. This can be used for both the user sensing means and the sheet sensing means.

Box 101 and 102 denote IR emitter(s) and receiver(s) respectively, corresponding generally to the previously described emitters 10, 12 and receivers 9, 11 and 13. The emitter 17 and the receiver 18 of the sheet sensing means can be arranged to fit in the control circuit in the same way as emitters 10, 12 and receivers 9, 11, 13 as these are also IR emitters and receivers. The hand symbol indicates that IR radiation from emitter(s) 101 is reflected by a user's hand back to receiver(s) 102. This is the same as for a sheet sensing means, whereby the sheet reflects IR from emitter 17 back to the receiver 18.

Unit 103 is a photo-electric converter for converting the received IR signal before it is passed to filtering and amplification unit 104 where the band pass filter and amplification circuits operate to amplify the received signal around the central frequency in a limited band width and to thereby suppress other IR frequencies relatively. The signal is then passed to a signal rectification unit 105, since the IR signal is an AC signal. From the unit 105, the signal passes into the A/D module of the MCU. The use of pulsed IR is however not an absolute requirement, in particular for the sheet sensing means.

The output of the PWM module 106 (pulse width module) is controlled by the MCU such that a square wave signal from the PWM can have its duty cycle varied by the MCU to adjust the DC voltage to the emitter circuits and thus the power of the IR signal emitted. The PWM 106 is connected to a D/A converter 107 and into an IR emitter driving circuitry unit 109 which includes the constant current sink mentioned previously. Into the same IR emitter driving circuitry is also fed a signal from a phase frequency detection module 108 which issues a 15 kHz (±0.5%) impulse modulated signal (or another frequency of modulated signal as considered appropriate) so as to drive the emitters 101 via the emitter driving circuitry 109 to emit modulated IR signals for short intervals (e.g. each signal is emitted for about 1 ms). In this regard it should be noted that before the modulated signal is emitted, the MCU should first have already put the filter and amplification circuit unit 104 for the received signal into operation for a short period, e.g. 2.5 ms, before emitting a modulated pulse, so as to allow the receiver circuit to stabilise, so as to reliably detect reflected IR from the emitted IR signal. As explained previously, for the paper sensing means, the receiver circuit may be set to be on constantly due to the very short scan interval used during motor operation.

Since the unit 104 is already in operation when the IR scanning pulse is emitted, and since the filters and amplification unit are centered around the central frequency of the emitted pulse, there is no need to synchronise the timing of the emitted pulse and the received pulse to any further extent.

The signal from unit 109 feeds into the IR emitter on/off control unit 110. The input/output module 118 of the MCU also feeds into the unit 110 to be turned on and off as required to thereby perform an IR scan via the emitter 101.

In order to activate the microprocessor (i.e. wake it up to perform a user scan or a sheet sensing scan at a certain rate as mentioned above), RC wake-up circuitry 115 may feed into the MCU into a wake-up detection unit 114. For the sheet sensing means during the time the motor is in operation, the MCU can preferably be maintained constantly awake, as the sheet product scan interval is very short. Unit 117 is an external interrupt detection unit.

From the input/output module 118 is a feed to unit 119 which can be regarded as the motor driving circuitry which drives the motor M when the sensor system (which preferably includes the MCU and software) has detected that sheet product should be dispensed due to the determination of the presence of a user in the dispensing zone 14.

Further peripheral units 111, 112 are respectively a paper sensing means (the operation of which is described in more detail above with respect to FIGS. 2 to 5), and a low power detection circuit (i.e. for detecting battery power). The connections for this are not shown, but will be similar to those used for the user sensing means. Unit 116 indicates battery power which is used to drive the MCU and also all other peripherals and the motor M. Unit 120 may be motor overload circuitry which cuts off power to the motor for example when sheet product becomes jammed in the dispenser or when there is no sheet product in the dispenser. Unit 121 is a sheet product length control unit (which may itself be variably adjustable by manual operation e.g. of a variable resistor or the like) which operates such that a predetermined, constant length of sheet product is dispensed each time the motor is made to operate to feed a length of sheet product 7 through the discharge opening 8. This unit 121 may also include a low power compensation module by which the motor under lower power is made to turn for a longer period of time in order to dispense the same length of sheet product, although the unit may simply be a pulse position control system whereby the rotation of the motor M is counted in a series of pulses and the rotation is stopped only when the exact number of pulses has been achieved. Such a pulse position control system could include for example a fixedly located photointerruptor which can detect slots in a corresponding slotted unit fixed to the motor drive shaft (or alternatively on the drive roller 5 operably connected to the drive motor). Unit 122 may be low sheet product detection circuitry and unit 123 may be used to indicate whether the casing is open or closed. This can for example be used to provide automatic feeding of a first portion of sheet product from the roll 3 through the discharge opening when the case is closed, e.g. after refilling with a new roll of e.g. paper, so that the person refilling the dispenser is assured that the device is dispensing properly after having been closed.

Although not shown here, a series of warning or status indication lights may be associated for example with various units such as units 111, 112, 120 to 123 to indicate particular conditions to a potential user or dispenser attendant or repairman (e.g. if the dispenser motor is jammed or the dispenser needs refilling with paper or the like).

Figure 9:
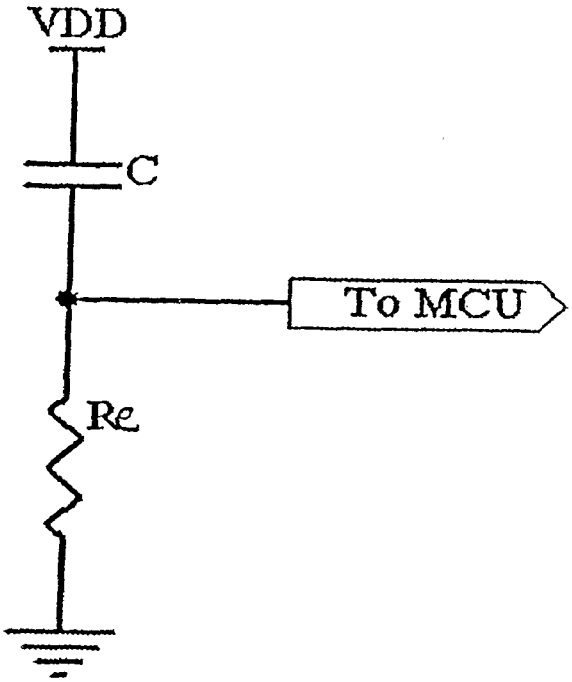
FIG. 9 shows an RC circuit used for effecting wake-up of the microprocessor in the MCU so as to perform a scan.

FIG. 9 shows one embodiment of an RC control circuitry which can be used to give a timed wake-up of the microprocessor in the MCU. The principle of such a circuit is well known and in the present case a suitable value for the resistor Re is 820 kOhm and for the capacitor 0.33 microfarads. Although not shown specifically in FIG. 7, the RC wake-up circuitry uses the input/output unit 118 of the MCU to provide the timed wake-up function of the microprocessor so that a scan occurs at the prescribed time interval (t1, t2 or t3 for example). When there is a high to low voltage drop at the input/output, as a result of the RC circuitry, the MCU will "wake-up" and perform a scan. This wake-up leading to the performing of a user sensing scan also requires supporting software. Likewise the length of the time t1 and/or t2 and/or t3 can suitably be made as a multiple of the RC circuitry time constant, whereby the input from the RC circuit can be used in the software to determine whether a scan is required or not at each interval. In this regard it will be noted that an RC circuit is subject to voltage changes at the input (via VDD which is the MCU supply voltage source acquired after passing through a diode from the battery voltage supply). As the voltage of the battery (or batteries) drops, there will then be an increase in the RC time constant in the circuit of FIG. 9 and thus the times t1, t2 and t3 set initially will vary as the batteries become more depleted. For example, with the time t1 set at the preferred level of 0.17 seconds for a battery level of 6V, a drop to depletion level of 4.2V will increase time t1 to 0.22s. Thus, the values of t1, t2, t3 etc., as used herein, are to be understood as being the values with a fully charged battery source. Likewise the first scan interval and the second scan interval for use in the sheet sensing means are also values determined at full battery power.

Figure 10:
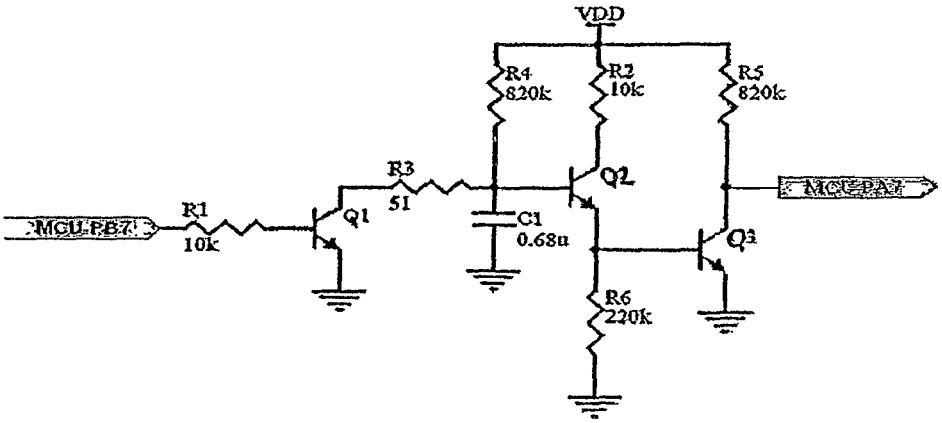
FIG. 10 shows an alternative version of the RC circuit depicted in FIG. 9.

FIG. 10 shows a modified RC circuit which has the advantage of using less current than the circuit shown in FIG. 9. In FIG. 10, three bipolar transistors are used to minimise the current used when the MCU is asleep.

By the circuitry in FIG. 9, the modification includes the use of two input/output ports PA7 (right hand side in the Figure) and PB7 (left hand side in the Figure) to the MCU. The important aspect of this circuit is that two transistors Q2 and Q3 have been added in cascade which together modify the RC charge-up characteristics. The MCU PA7 pin then gives a much sharper charge-up curve. The delay time constant for waking up the MCU is determined by R4 and C1, which have been given values of 820 kOhm and 0.68 μF respectively in the example shown. Other values for other time constants can of course be chosen.

The fast voltage change at port PA7 is achieved after conversion in Q2 and Q3, which minimizes the time required for transition from a logic High voltage to a logic Low voltage level. Such a circuit as in FIG. 9 can achieve about 40% power reduction during the sleep cycle compared to the FIG. 8 circuitry for approximately the same RC time constants. Thus the RC timing circuitry of FIG. 9 is particularly advantageous where maximum power is to be saved.

The invention claimed is:

1. A dispenser, comprising:

means for feeding driven by a motor, said means for feeding being configured for dispensing a portion of sheet product stored in said dispenser;

a dispensing outlet through which said sheet product is fed upon a feed command being issued by a means for control;

means for tearing against which a region of said sheet product is to be drawn so as to allow said sheet portion to be torn and removed from a remaining portion of a sheet product supply;

means for sheet sensing configured for detecting a presence of sheet product in front of a specific region of said dispenser proximate said dispensing outlet, said means for sheet sensing being connected to said means for control to form a sensing system, said means for control including a memory for storing information from a previous scan by said means for sheet sensing performed during operation of said motor; and means for user sensing connected to said means for control, said means for user sensing providing a signal to said means for control upon detection of the presence of a user to allow said means for control to issue a sheet feed command, wherein said means for sheet sensing is arranged to repeatedly scan said specific region at a first scan interval for the presence of sheet product or a discontinuation of said sheet product during an entire operation of said motor up to ceasing of operation of said motor, and said means for sheet sensing is arranged to send a signal to said means for control to indicate that sheet product has been torn whenever said sensing system detects a discontinuation of sheet product during said entire operation of the motor, said means for control is arranged to issue a sheet feed command when a discontinuation has been detected in said previous scan during operation of said motor, and wherein said means for control is arranged to maintain a control condition not to issue a sheet feed command if no discontinuation has been detected in said previous scan until such time as a further single scan, during a time without operation of said motor, detects a discontinuation, and the means for control is arranged such that, when a discontinuation has not been detected on a previous scan, a second single scan is performed by said means for paper sensing at a second scan interval after said previous scan during a time without operation of said motor wherein said second scan interval is longer than said first scan interval performed during operation of said motor, and wherein if sheet product is detected during said second single scan, a further single scan is performed on a repeating basis at said second scan interval, until sheet product is not detected.

2. The dispenser according to claim 1, wherein said specific region is arranged downstream of said means for tearing.

3. The dispenser according to claim 2, wherein the means for control is arranged to operate the motor such that a predetermined length of sheet product is fed by said means for feeding at least when no discontinuation in said sheet product is detected during said entire operation of said motor.

4. The dispenser according to claim 1, wherein the means for control is arranged to operate the motor such that a predetermined length of sheet product is fed by said means for feeding at least when no discontinuation in said sheet product is detected during said entire operation of said motor.

5. The dispenser according to claim 1, wherein said means for sheet sensing comprises at least one IR emitter, and at least one IR receiver arranged to receive IR emitted by said IR emitter and reflected by sheet product blocking the IR path to said specific region.

6. The dispenser according to claim 1, wherein said specific region is located on a surface of said dispenser housing.

7. The dispenser according to claim 6, wherein a relatively dark area, with respect to the colour of said sheet product, is arranged on said surface of said dispenser housing.

8. The dispenser according to claim 7, wherein said relatively dark area is a black area covering at least part of said surface of said dispenser housing.

9. The dispenser according to claim 8, further including a means for user sensing connected to said means for control, said means for user sensing providing a signal to said means for control upon detection of the presence of a user to allow said means for control to issue a sheet feed command.

10. The dispenser according to claim 1, in which said second scan interval increases to a third longer scan interval upon a predetermined number of second scan intervals being exceeded.

11. The dispenser according to claim 1, wherein said first scan interval is less than or equal to 20 ms.

12. The dispenser according to claim 1, wherein said first scan interval is less than or equal to 3ms.

13. The dispenser according to claim 1, wherein the control system is arranged to supply a command signal to the drive motor of said means for feeding to stop said drive motor upon detection of a discontinuation in the sheet product.

14. A dispenser, comprising:

means for feeding driven by a motor, said means for feeding being configured for dispensing a portion of sheet product stored in said dispenser;

a dispensing outlet through which said sheet product is fed upon a feed command being issued by a means for control;

means for tearing against which a region of said sheet product is to be drawn so as to allow said sheet portion to be torn and removed from a remaining portion of a sheet product supply; and means for sheet sensing configured for detecting a presence of sheet product in front of a specific region of said dispenser proximate said dispensing outlet, said specific region being located on a surface of said dispenser housing, said means for sheet sensing being connected to said means for control to form a sensing system, wherein said means for sheet sensing is arranged to repeatedly scan said specific region at a first scan interval for the presence of sheet product or a discontinuation of said sheet product during an entire operation of said motor up to ceasing of operation of said motor, and said means for sheet sensing is arranged to send a signal to said means for control to indicate that sheet product has been torn whenever said sensing system detects a discontinuation of sheet product during said entire operation of the motor, a relatively dark area, with respect to the colour of said sheet product, is arranged on said surface of said dispenser housing, said relatively dark area being a black area covering at least part of said surface of said dispenser housing, and said second scan interval is the same as a scanning interval determined by a microprocessor wake-up circuit used for determining the scanning interval for detecting presence of a user, whereby the scan interval in the means for sheet sensing is the same as, and performed at the same time as, the scan for detection of a said user.

15. A dispenser, comprising:

means for feeding driven by a motor, said means for feeding being configured for dispensing a portion of sheet product stored in said dispenser;

a dispensing outlet through which said sheet product is fed upon a feed command being issued by a means for control;

means for tearing against which a region of said sheet product is to be drawn so as to allow said sheet portion to be torn and removed from a remaining portion of a sheet product supply; and means for sheet sensing configured for detecting a presence of sheet product in front of a specific region of said dispenser proximate said dispensing outlet, said means for sheet sensing being connected to said means for control to form a sensing system, wherein said means for sheet sensing is arranged to repeatedly scan said specific region at a first scan interval for the presence of sheet product or a discontinuation of said sheet product during an entire operation of said motor up to ceasing of operation of said motor, and said means for sheet sensing is arranged to send a signal to said means for control to indicate that sheet product has been torn whenever said sensing system detects a discontinuation of sheet product during said entire operation of the motor, and said means for control is arranged to stop said means for sheet sensing from performing a scan at said first scan interval upon cessation of operation of said motor.

16. A dispenser, comprising:

means for feeding driven by a motor, said means for feeding being configured for dispensing a portion of sheet product stored in said dispenser;

a dispensing outlet through which said sheet product is fed upon a feed command being issued by a means for control;

means for tearing against which a region of said sheet product is to be drawn so as to allow said sheet portion to be torn and removed from a remaining portion of a sheet product supply;

means for sheet sensing configured for detecting a presence of sheet product in front of a specific region of said dispenser proximate said dispensing outlet, said means for sheet sensing being connected to said means for control to form a sensing system; and means for user sensing connected to said means for control, said means for user sensing providing a signal to said means for control upon detection of the presence of a user to allow said means for control to issue a sheet feed command, wherein said means for sheet sensing is arranged to repeatedly scan said specific region at a first scan interval for the presence of sheet product or a discontinuation of said sheet product during an entire operation of said motor up to ceasing of operation of said motor, and said means for sheet sensing is arranged to send a signal to said means for control to indicate that sheet product has been torn whenever said sensing system detects a discontinuation of sheet product during said entire operation of the motor, and said second scan interval is the same as a scanning interval determined by a microprocessor wake-up circuit used for determining the scanning interval for detecting presence of a user, whereby the scan interval in the means for sheet sensing is the same as, and performed at the same time as, the scan for detection of a user.

* * * * *